US011959265B2

(12) United States Patent
Zhou et al.

(10) Patent No.: US 11,959,265 B2
(45) Date of Patent: Apr. 16, 2024

(54) REGULATING DEVICE FOR REGULATING WATER CONSUMPTION OF CONCEALED WATER TANK

(71) Applicant: ZHONGSHAN MEITU PLASTIC IND. CO., LTD., Zhongshan (CN)

(72) Inventors: Wenhui Zhou, Zhongshan (CN); Hai Zhang, Zhongshan (CN); Haojia Huang, Zhongshan (CN); Ke Xiao, Zhongshan (CN)

(73) Assignee: ZHONGSHAN MEITU PLASTIC IND. CO., LTD., Zhongshan (CN)

( * ) Notice: Subject to any disclaimer, the term of this patent is extended or adjusted under 35 U.S.C. 154(b) by 221 days.

(21) Appl. No.: 17/676,927

(22) Filed: Feb. 22, 2022

(65) Prior Publication Data

US 2023/0057200 A1 Feb. 23, 2023

(30) Foreign Application Priority Data

Aug. 21, 2021 (CN) ..... 202121976080.6

(51) Int. Cl.
*E03D 3/12* (2006.01)

(52) U.S. Cl.
CPC ..... *E03D 3/12* (2013.01); *E03D 2201/30* (2013.01)

(58) Field of Classification Search
CPC .... E03D 3/12; E03D 1/14; E03D 1/22; E03D 2201/30
See application file for complete search history.

(56) References Cited

U.S. PATENT DOCUMENTS

| | | | | |
|---|---|---|---|---|
| 946,130 | A | 1/1910 | Hawkins | |
| 4,009,497 | A * | 3/1977 | Moon | E03D 1/22 4/378 |
| 4,144,600 | A * | 3/1979 | Mayes | E03D 1/14 4/324 |
| 4,388,737 | A * | 6/1983 | Wenzel | E03D 1/142 4/324 |
| 4,419,772 | A | 12/1983 | Smith | |
| 6,317,899 | B1 * | 11/2001 | Brewer | E03D 1/20 4/325 |
| 2010/0251470 | A1 * | 10/2010 | Lake | E03D 1/14 4/353 |
| 2011/0289668 | A1 * | 12/2011 | Neves | E03D 5/09 4/324 |

FOREIGN PATENT DOCUMENTS

| | | | |
|---|---|---|---|
| DE | 2216918 | A1 | 10/1973 |
| KR | 20120039427 | A | 4/2012 |

* cited by examiner

*Primary Examiner* — J C Jacyna
(74) *Attorney, Agent, or Firm* — Bayramoglu Law Offices LLC

(57) ABSTRACT

A regulating device for regulating water consumption of a concealed water tank includes a water tank, a hinged base is fixedly arranged on the inner wall of the water tank, a water separator is hinged on the hinged base. A regulating mechanism is arranged between the hinged base and the water separator, and the regulating mechanism can drive the water separator to rotate and fix to divide the accommodation space of the water tank. Compared with the prior art, the regulating device realizes the variable volume of the water tank by regulating the rotation of the water separator through the regulating mechanism. The structure is simple and convenient for the later repair and maintenance of the water tank.

14 Claims, 8 Drawing Sheets

A-A

REGULATING DEVICE FOR REGULATING WATER CONSUMPTION OF CONCEALED WATER TANK

CROSS REFERENCE TO THE RELATED APPLICATIONS

This application is based upon and claims priority to Chinese Patent Application No. 202121976080.6, filed on Aug. 21, 2021, the entire contents of which are incorporated herein by reference.

TECHNICAL FIELD

The disclosure relates to the technical field of toilet, in particular to a regulating device for regulating water consumption of a concealed water tank.

BACKGROUND

The flushing volume of the existing toilet water tank can not be regulated. Generally, once the flushing button is pressed, all the water in the toilet water tank will be discharged from the water outlet of the water tank at once. Although it has large flushing force, it wastes water. In order to meet the demand of water-saving performance of toilet and prevent excessive waste of water resources, there are some devices on the market that can regulate the capacity of water tank. The device is a water separator installed in the water tank by plugging and pulling, which divides the water tank into two, so as to achieve the effect of reducing the capacity of water tank. The structure and operation of the device is particularly troublesome, and it is not convenient for the later cleaning and maintenance of the water tank.

SUMMARY

In order to solve the above problems, a regulating device for regulating water consumption of a concealed water tank is provided by the present disclosure, which has the advantages in simple structure, convenient installation and easy later repair and maintenance.

In order to achieve the above objective, the present disclosure provides the following technical solution:

A regulating device for regulating water consumption of a concealed water tank, including a water tank, a hinged base is fixedly arranged on an inner wall of the water tank, wherein a water separator is hinged on the hinged base, and a regulating mechanism is provided between the hinged base and the water separator; the regulating mechanism is configured to drive the water separator to rotate and fix to divide accommodation space of the water tank, the upper and lower parts of the side end of the water separator are respectively provided with an upper pivot and a lower pivot, an upper hinge hole and a lower hinge hole for inserting the upper pivot and the lower pivot are correspondingly arranged at upper and lower parts of the hinged base, and the water separator is correspondingly inserted into the upper hinge hole and the lower hinge hole through the upper pivot and the lower pivot. Wherein the regulating mechanism includes a knob, the knob includes a knob body and an insertion portion provided at a lower end of the knob body, the upper hinge hole is arranged from top to bottom, and the lower end of the insertion portion is provided with an insertion hole; after the knob is inserted into the upper hinge hole from top to bottom through the insertion portion, the insertion hole is sleeved on the peripheral surface of the upper pivot, so that the knob is fixed relative to the upper pivot in the circumferential direction and movable relative to the upper pivot in the axial direction.

As a further improvement, the periphery of the knob body is fixedly provided with a snap portion, the hinged base is provided with an open position snap slot and a closed position snap slot, wherein the open position snap slot and the closed position snap slot are configured for receiving of the snap portion; in the open state, the snap portion is snapped in the open position snap slot; in the closed state, the water separator is driven to rotate by rotation of the the knob after the knob is lifted up to separate the snap portion from the open position snap slot, so as to make the snap portion enter the closed position snap slot to separate the accommodation space of the water tank.

As a further improvement, an upper end of the knob body is provided with a accommodation hole communicated with the insertion hole, the accommodation hole is larger than a maximum diameter of the insertion hole, so that a step is formed between the accommodation hole and the insertion hole; a fixing member fixedly connected with an upper end of the upper pivot is provided in the accommodation hole, a spring located between the fixing member and the step and sleeved on an outer circumference of the upper pivot is arranged in the accommodation hole, when the snap portion of the knob is rotated to a position corresponding to the open position snap slot or the closed position snap slot, the spring drives the snap portion of the knob to snap into the open position snap slot or the closed position snap slot.

As a further improvement, a contact portion is provided at a bottom end and an opposite end hinged with the hinged base of the water separator, and the thickness of the contact portion is less than that of the water separator; and when in the closed state, the contact portion is against the side wall and the bottom wall of the water tank respectively.

As a further improvement, the upper pivot is divided from top to bottom into a sleeve portion configured to fixedly connect the fixing member and a tight fitting portion matched with the insertion hole, and a snap block is arranged opposite to an outer circumference of the sleeve portion, a lower end of the fixing member is provided with a sleeve hole, the outer circumference of the fixing member is correspondingly provided with a snap opening communicated with the sleeve hole and corresponding to the snap block, and the fixing member is correspondingly snapped into the snap block through the snap opening.

As a further improvement, the outer surface of the snap block is inclined outward from top to bottom.

As a further improvement, a notch formed by penetrating from top to bottom is arranged on the side wall of the upper hinge hole.

As a further improvement, the radial width of the notch is greater than the diameter of the upper pivot and less than the diameter of the upper hinge hole.

As a further improvement, two L-shaped fixing strips are symmetrically arranged on the inner wall of the water tank, and the two L-shaped fixing strips form a plug-in slot suitable for the hinged base.

As a further improvement, the water separator is made of polypropylene (PP).

As a further improvement, the cross section of the insertion hole is hexagonal, and the cross section of the upper pivot is hexagonal.

As a further improvement, the thickness of the contact portion of the water separator is 0.1 to 0.5 mm.

As a further improvement, the water separator divides the accommodation space into two.

As a further improvement, the volume of the water tank is changed from 6 L to 4.5 L by the regulating device.

The advantageous effects of the present disclosure are as following: when the water separator is operated by the regulating mechanism to rotate against the inner wall of the water tank, the water separator divides the accommodation space into two. For example, the capacity of the water tank is 6 L, and the capacity of the water tank can be changed to 4.5 L after being regulated by the device, so as to realize the water-saving effect. Compared with the prior art, the present disclosure realizes the variable volume of the water tank by regulating the rotation of the water separator through the regulating mechanism. The structure is simple and convenient for the later repair and maintenance of the water tank.

DETAILED DESCRIPTION OF THE EMBODIMENTS

Figure 1:
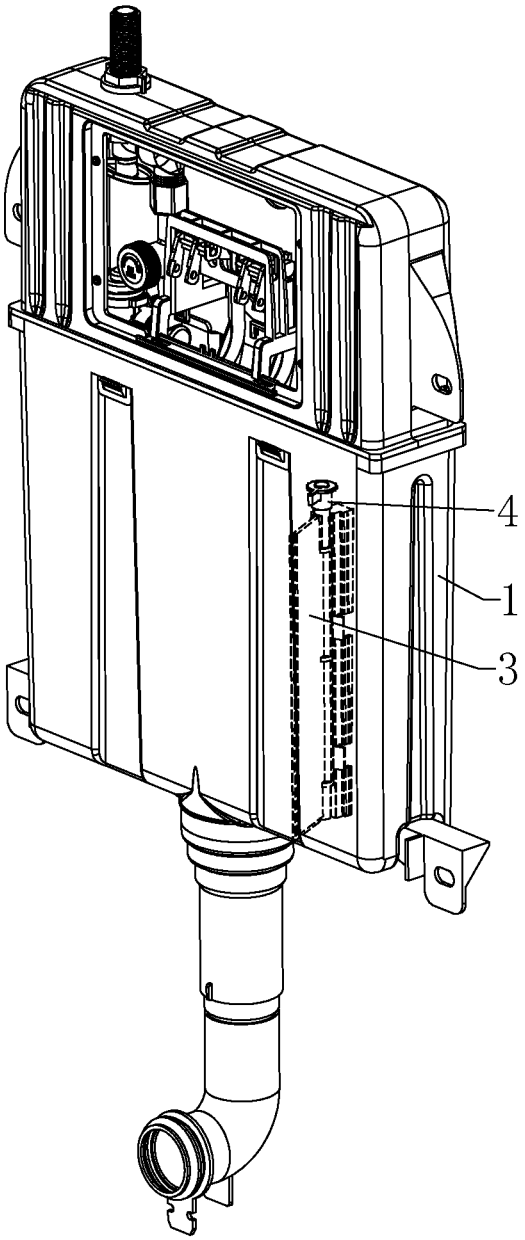
FIG. 1 is a structural diagram of the present disclosure.
Figure 2:
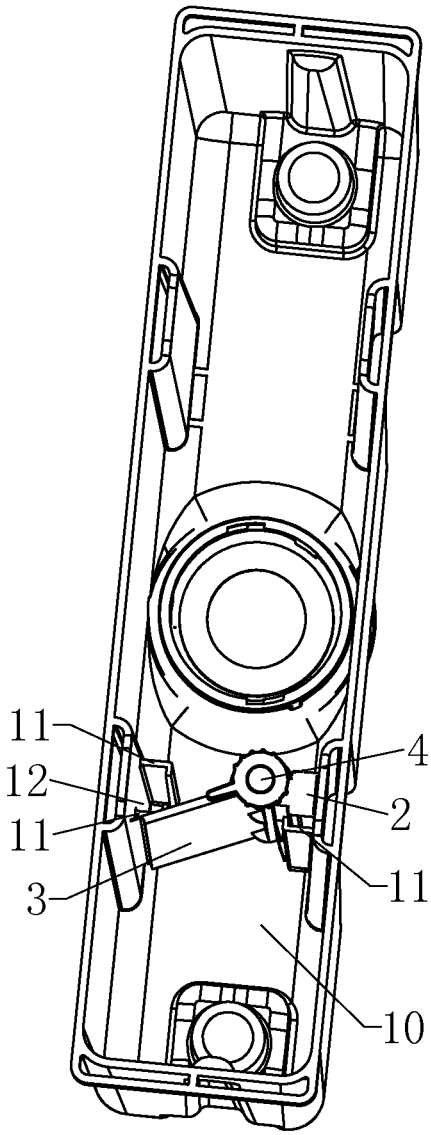
FIG. 2 is a structural diagram of the closed state of the regulating mechanism.
Figure 3:
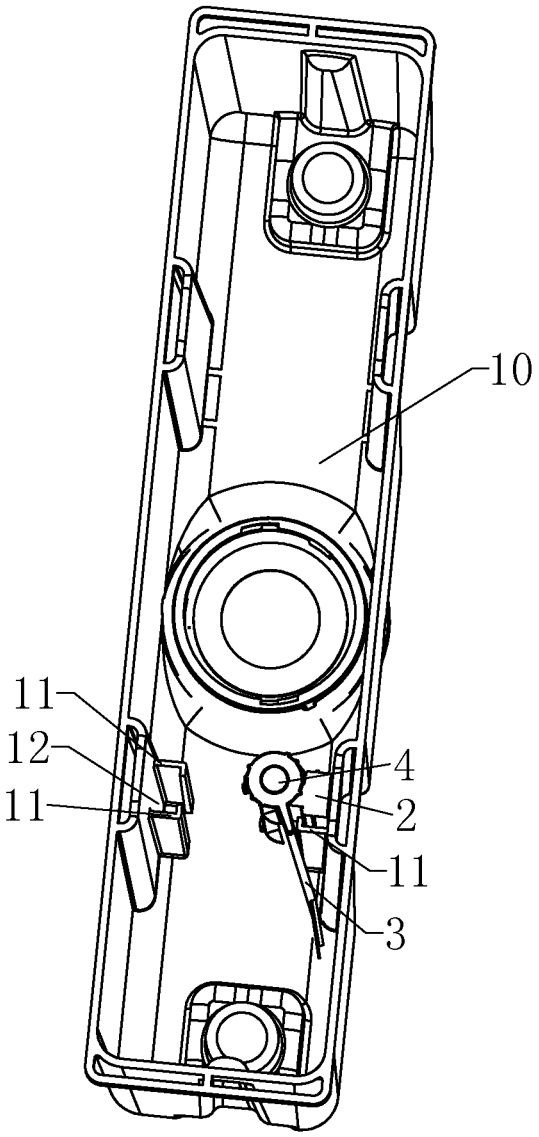
FIG. 3 is a structural diagram of the open state of the regulating mechanism.
Figure 4:
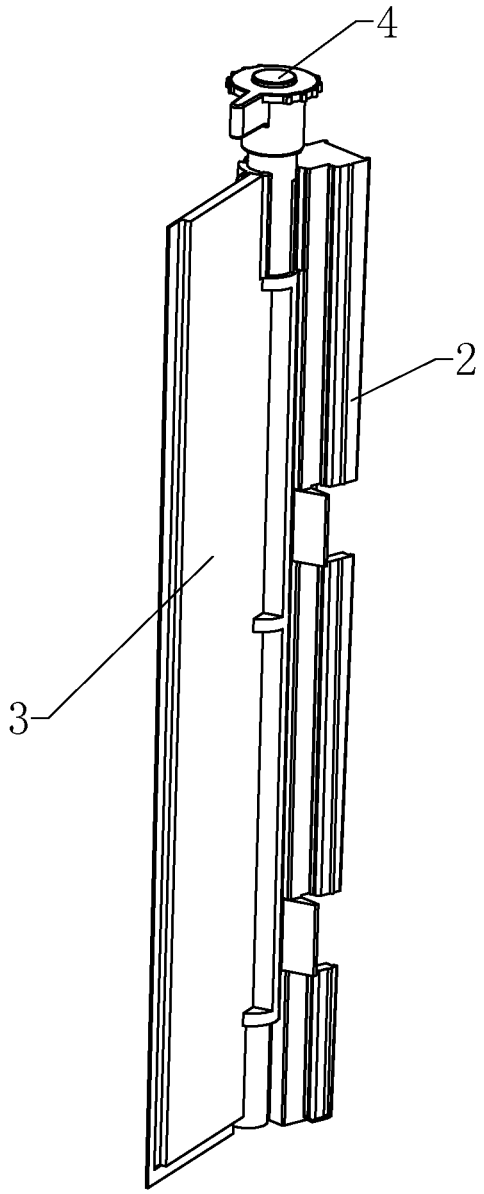
FIG. 4 is a structural diagram of the regulating mechanism.
Figure 5:
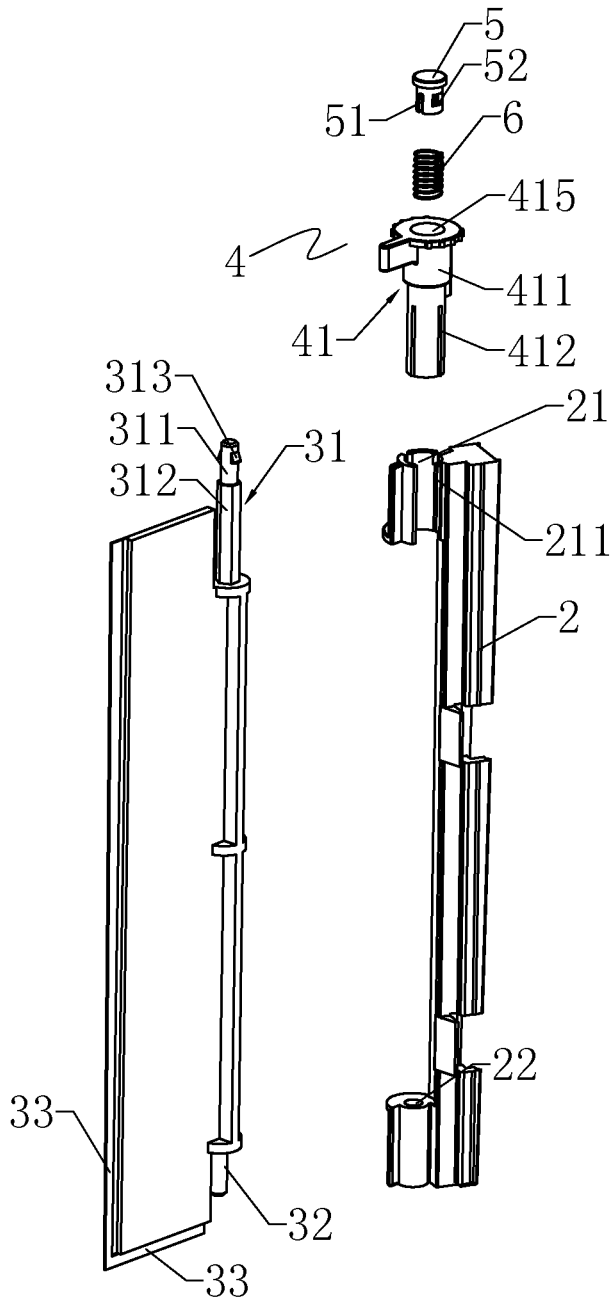
FIG. 5 is an exploded view of the regulating mechanism.
Figure 6:
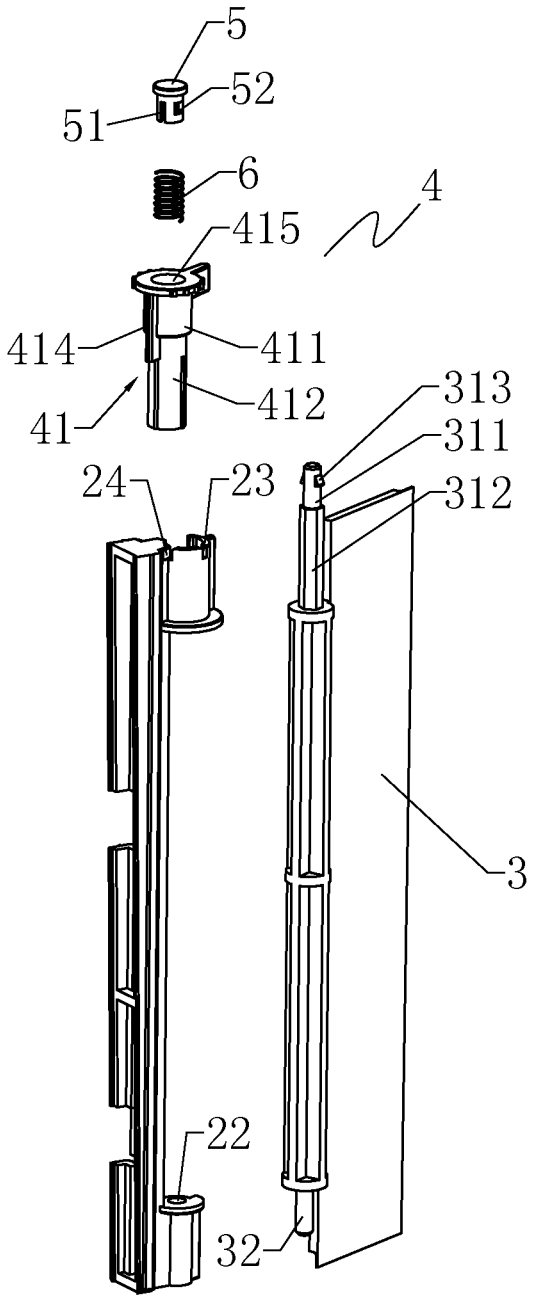
FIG. 6 is the second exploded view of the regulating mechanism.
Figure 7:
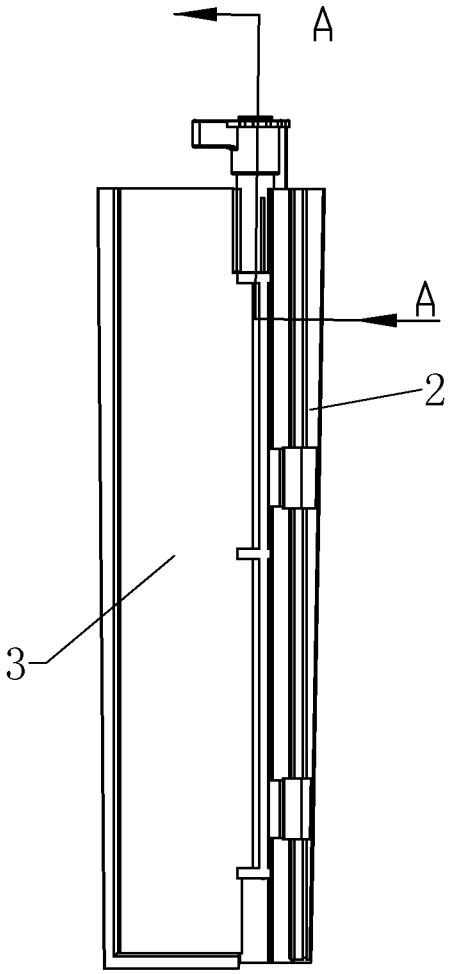
FIG. 7 is a front view of the regulating mechanism.
Figure 8:
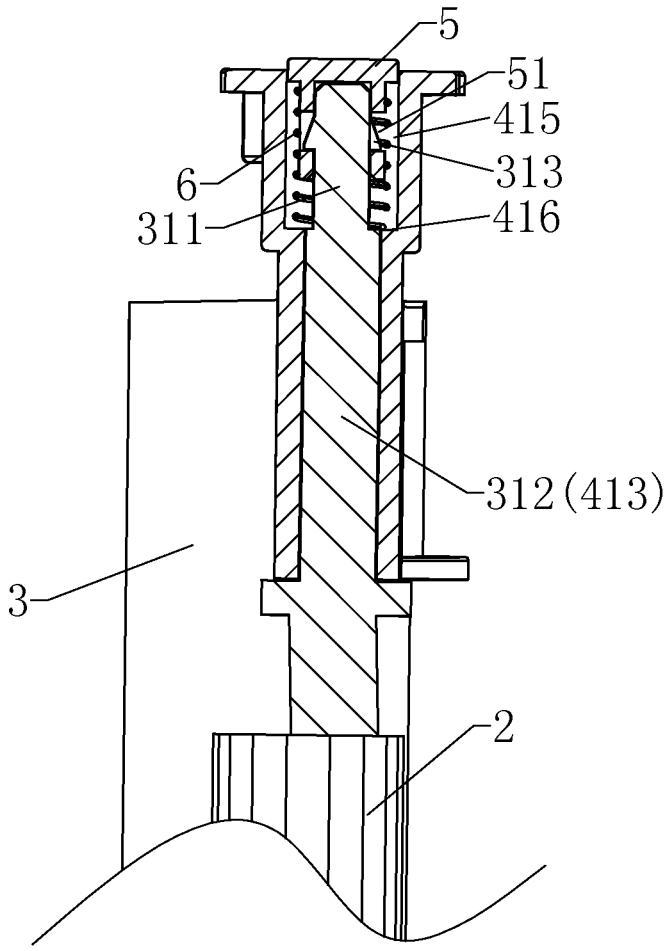
FIG. 8 is a sectional view at A-A of FIG. 7.

The disclosure will be further described in detail below in combination with the accompanying drawings and specific embodiments:

As shown in FIG. 1 to FIG. 8, a regulating device for regulating water consumption of the concealed water tank includes a water tank 1. A hinged base 2 is fixedly arranged on the inner wall of the water tank 1, a water separator 3 is hinged on the hinged base 2, and an regulating mechanism 4 is arranged between the hinged base 2 and the water separator 3. The regulating mechanism 4 can drive the water separator 3 to rotate and then fix it to separate the accommodation space 10 of the water tank 1. When the water separator 3 is operated by the regulating mechanism 4 to rotate against the inner wall of the water tank 1, the water separator 3 can divide the accommodation space 10 into two. For example, the volume of the water tank 1 is 6 L, and the volume of the water tank can be changed to 4.5 L after being regulated by the device, so as to achieve water-saving effect. Compared with the prior art, the present disclosure can realize the variable volume of the water tank 1 by regulating the rotation of the water separator 3 through the regulating mechanism 4. The structure is simple and convenient for the later repair and maintenance of the water tank 1.

In this embodiment, preferably, the hinge mode of the water separator 3 is as follows: the upper and lower parts of the side end of the water separator 3 are respectively provided with an upper pivot 31 and a lower pivot 32, and the upper and lower parts of the hinged base 2 are respectively provided with an upper hinge hole 21 and a lower hinge hole 22 for the insertion of the upper pivot 31 and the lower pivot 32 correspondingly. The upper pivot 31 and the lower pivot 32 of the water separator 3 are correspondingly inserted into the upper hinge hole 21 and the lower hinge hole 22 respectively, so that the rotation of the water separator 3 is realized.

In this embodiment, the regulating mechanism 4 includes a knob 41, the knob 41 includes a knob body 411 and an insertion portion 412 arranged at the lower end of the knob body 411. The upper hinge hole 21 is arranged from top to bottom, and the lower end of the insertion part 412 is provided with an insertion hole 413. After the insertion portion 412 of the knob 41 is inserted into the upper hinge hole 21 from top to bottom, the insertion hole 413 is sleeved on the peripheral surface of the upper pivot 31, so that the knob 41 is fixed relative to the upper pivot 31 in the circumferential direction and is movable relative to the upper pivot 31 in the axial direction. Preferably, the cross section of the insertion hole 413 is hexagonal, similarly, the cross section of the upper pivot 31 is also hexagonal, so as to achieve the technical effect that the knob 41 is fixed relative to the upper pivot 31 in the circumferential direction and is movable relative to the upper pivot 31 in the axial direction.

In this embodiment, the periphery of the knob body 411 is fixedly provided with a snap portion 414, the hinged base 2 is provided with two open position snap slot 23 and closed position snap slot 24, wherein the open position snap slot and the closed position snap slot are configured for receiving of the snap portion 414. In the open state, the snap portion 414 is snapped in the open position snap slot 23; in the closed state, the water separator 3 is driven to rotate by the rotation of the knob 41 after the knob 41 is lifted up to separate the snap portion 414 from the open position snap slot 23, so as to make the snap portion 414 enter the closed position snap slot 24 to separate the accommodation space 10 of the water tank 1. The snap portion 414 can snap into the open position snap slot 23 or the closed position snap slot 24, respectively, to facilitate the maintenance of the post-variable volume of the water tank.

In this embodiment, the upper end of the knob body 411 is provided with a accommodation hole 415 communicated with the insertion hole 413, the accommodation hole 415 is larger than the maximum diameter of the insertion hole 413, so that a step 416 is formed between the accommodation hole 415 and the insertion hole 413. A fixing member 5 fixedly connected with the upper end of the upper pivot 31 is provided in the accommodation hole 415, and a spring 6 is arranged in the accommodation hole 415, and the spring is located between the fixing member 5 and the step 416 and sleeved on the outer circumference of the upper pivot 31. When the snap portion 414 of the knob 41 is rotated to a position corresponding to the open position snap slot 23 or the closed position snap slot 24, the spring 6 drives the snap portion 414 of the knob 41 to snap into the open position snap slot 23 or the closed position snap slot 24. One end of the spring 6 is against the step 416 and the other end of the spring is against the fixing member 5, so as to facilitate the knob 41 to enter the snap position after rotating, and then limit the rotation of the knob 41.

In this embodiment, a contact portion 33 is provided at the bottom end and the opposite end hinged with the hinged base 2 of the water separator 3, and the thickness of the contact portion 33 is less than that of the water separator 3. When in the closed state, the contact portion 33 is against the side wall and the bottom wall of the water tank 1 respectively. The water separator 3 is made of PP, and the thickness of the contact portion 33 of the water separator 3 is 0.1 to 0.5 mm, so that the contact portion 33 has certain flexibility, which is conducive to the full contact between the contact portion 33 and the side wall and the bottom wall of the water tank 1, so that the water separator 3 has the effect of sealing and water separation.

In this embodiment, the upper pivot 31 is divided from top to bottom into a sleeve portion 311 configured to fixedly connect the fixing member 5 and a tight fitting portion 312 matched with the insertion hole 413, and a snap block 313 is arranged opposite to the outer circumference of the sleeve portion 311. The outer surface of the snap block 313 is inclined outward from top to bottom. The lower end of the fixing member 5 is provided with a sleeve hole 51, the outer circumference of the fixing member 5 is correspondingly provided with a snap opening 52 communicated with the sleeve hole 51 and corresponding to the snap block 313, and the fixing member 5 is correspondingly snapped into the snap block 313 through the snap opening 52. A notch 211 formed by penetrating from top to bottom is arranged on the side wall of the upper hinge hole 21. The radial width of the notch 211 is greater than the diameter of the upper pivot 31 and less than the diameter of the upper hinge hole 21. The specific installation steps are as follows: 1. First, assembling the lower pivot 32 in the lower hinge hole 22, and at the same time, assembling the upper pivot 31 in the upper hinge hole 21 through the notch 211 from outside to inside; 2. Inserting the insertion portion 412 of the knob 41 into the upper hinge hole 21 from top to bottom, so that the insertion hole 413 of the insertion portion 412 is sleeved on the peripheral surface of the upper pivot 31; 3. Putting the spring 6 on the outer circumference of the upper pivot 31; 4. Inserting the fixing member 5 into the accommodation hole 415 so that the snap block 313 of the upper pivot 31 snaps into the snap opening 52 of the fixing member 5, here the installation is completed. The structure is simple and easy to install, which is conducive to the later cleaning and maintenance of the water tank.

In this embodiment, two L-shaped fixing strips 11 are symmetrically arranged on the inner wall of the water tank 1, and the two L-shaped fixing strips 11 surround each other to form a plug-in slot 12 suitable for the hinged base 2, so as to facilitate the fixed installation of the hinged base 2 in the water tank.

What is claimed is:

1. A regulating device for regulating water consumption of a water tank, comprising a water tank, wherein a hinged base is fixedly arranged on an inner wall of the water tank, a water separator is hinged on the hinged base, and a regulating mechanism is provided between the hinged base and the water separator; the regulating mechanism is configured to drive the water separator to rotate and fix to divide an accommodation space of the water tank, upper and lower parts of an side end of the water separator are respectively provided with an upper pivot and a lower pivot, an upper hinge hole and a lower hinge hole for inserting the upper pivot and the lower pivot are correspondingly arranged at upper and lower parts of the hinged base, and the water separator is correspondingly inserted into the upper hinge hole and the lower hinge hole through the upper pivot and the lower pivot;

wherein the regulating mechanism comprises a knob, the knob comprises a knob body and an insertion portion provided at a lower end of the knob body, the upper hinge hole is arranged from top to bottom, and a lower end of the insertion portion is provided with an insertion hole; after the knob is inserted into the upper hinge hole from top to bottom through the insertion portion, the insertion hole is sleeved on a peripheral surface of the upper pivot, so that the knob is fixed relative to the upper pivot in a circumferential direction and movable relative to the upper pivot in an axial direction.

2. The regulating device for regulating water consumption of the water tank according to claim 1, wherein a periphery of the knob body is fixedly provided with a snap portion, the hinged base is provided with an open position snap slot and a closed position snap slot, wherein the open position snap slot and the closed position snap slot are configured for receiving of the snap portion; in the open state, the snap portion is snapped in the open position snap slot; in the closed state, the water separator is driven to rotate by rotation of the [[the]] knob after the knob is lifted up to separate the snap portion from the open position snap slot, so as to make the snap portion enter the closed position snap slot to separate the accommodation space of the water tank.

3. The regulating device for regulating water consumption of the water tank according to claim 2, wherein an upper end of the knob body is provided with an accommodation hole communicated with the insertion hole, the accommodation hole is larger than a maximum diameter of the insertion hole, so as to form a step between the accommodation hole and the insertion hole; a fixing member fixedly connected with an upper end of the upper pivot is provided in the accommodation hole, a spring located between the fixing member and the step and sleeved on an outer circumference of the upper pivot is arranged in the accommodation hole, when the snap portion of the knob is rotated to a position corresponding to the open position snap slot or the closed position snap slot, the spring drives the snap portion of the knob to snap into the open position snap slot or the closed position snap slot.

4. The regulating device for regulating water consumption of the water tank according to claim 3, wherein a contact portion is provided at a bottom end and an opposite end hinged with the hinged base of the water separator, and a thickness of the contact portion is less than that of the water separator; and when in the closed state, the contact portion is against a side wall and a bottom wall of the water tank respectively.

5. The regulating device for regulating water consumption of the water tank according to claim 1, wherein the upper pivot is divided from top to bottom into a sleeve portion configured to fixedly connect the fixing member and a tight fitting portion matched with the insertion hole, and a snap block is arranged opposite to an outer circumference of the sleeve portion, a lower end of the fixing member is provided with a sleeve hole, an outer circumference of the fixing member is correspondingly provided with a snap opening communicated with the sleeve hole and corresponding to the snap block, and the fixing member is correspondingly snapped into the snap block through the snap opening.

6. The regulating device for regulating water consumption of the water tank according to claim 5, wherein an outer surface of the snap block is inclined outward from top to bottom.

7. The regulating device for regulating water consumption of the water tank according to claim 1, wherein a notch formed by penetrating from top to bottom is arranged on a side wall of the upper hinge hole.

8. The regulating device for regulating water consumption of the water tank according to claim 7, wherein a radial width of the notch is greater than a diameter of the upper pivot and less than a diameter of the upper hinge hole.

9. The regulating device for regulating water consumption of the water tank according to claim 1, wherein two L-shaped fixing strips are symmetrically arranged on the inner wall of the water tank, and the two L-shaped fixing strips form a plug-in slot suitable for the hinged base.

10. The regulating device for regulating water consumption of the water tank according to claim 1, wherein the water separator is made of polypropylene (PP).

11. The regulating device for regulating water consumption of the water tank according to claim 1, wherein a cross section of the insertion hole is hexagonal, and a cross section of the upper pivot is hexagonal.

12. The regulating device for regulating water consumption of the water tank according to claim 4, wherein the thickness of the contact portion of the water separator is 0.1 to 0.5 mm.

13. The regulating device for regulating water consumption of the water tank according to claim 1, wherein the water separator divides the accommodation space into two.

14. The regulating device for regulating water consumption of the water tank according to claim 13, wherein a volume of the water tank is changed from 6 L to 4.5 L by the regulating device.

* * * * *